US008519312B1

(12) United States Patent
Merems

(10) Patent No.: US 8,519,312 B1
(45) Date of Patent: Aug. 27, 2013

(54) MISSILE WITH SHROUD THAT SEPARATES IN FLIGHT

(75) Inventor: Paul A. Merems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 608 days.

(21) Appl. No.: 12/696,123

(22) Filed: Jan. 29, 2010

(51) Int. Cl.

| | |
|---|---|
| ***B64G 1/52*** | (2006.01) |
| ***H01Q 1/42*** | (2006.01) |
| *B64G 1/00* | (2006.01) |
| *F41G 7/22* | (2006.01) |
| *H01Q 1/00* | (2006.01) |

(52) U.S. Cl.
USPC ..... 244/3.1; 244/1 R; 244/3.15; 244/117 R; 244/119; 244/121; 244/158.1; 244/171.7; 244/173.1; 343/872

(58) Field of Classification Search
USPC ..... 342/1–11; 343/872, 873; 102/293, 102/399; 244/1 R, 3.1–3.3, 158.1, 158.9, 244/159.1, 117 R, 119, 121, 173.1–173.3, 244/171.7
See application file for complete search history.

(56) References Cited

U.S. PATENT DOCUMENTS

| | | | | | |
|---|---|---|---|---|---|
| 3,135,204 | A | * | 6/1964 | Menichelli et al. | 102/399 |
| 3,351,947 | A | * | 11/1967 | Hart | 343/872 |
| 3,555,550 | A | * | 1/1971 | Walters | 342/2 |
| 3,913,108 | A | * | 10/1975 | Branen | 343/872 |
| 3,970,006 | A | * | 7/1976 | Copeland et al. | 244/159.1 |
| 4,867,357 | A | * | 9/1989 | Inglis et al. | 244/121 |
| 4,916,461 | A | * | 4/1990 | Brazel | 343/872 |
| 5,125,600 | A | * | 6/1992 | Brumbaugh | 244/121 |
| 5,159,151 | A | * | 10/1992 | Dransfield et al. | 102/293 |
| 5,167,386 | A | * | 12/1992 | Laquer et al. | 244/121 |
| 5,187,321 | A | * | 2/1993 | Tusch | 102/293 |
| 5,693,907 | A | * | 12/1997 | Rudnik | 102/293 |
| 5,743,492 | A | * | 4/1998 | Chan et al. | 244/173.1 |
| 5,961,078 | A | * | 10/1999 | Edberg et al. | 244/173.2 |
| 6,679,453 | B2 | * | 1/2004 | Steiner | 244/121 |
| 7,093,799 | B1 | * | 8/2006 | Dulat et al. | 244/121 |
| 7,661,625 | B2 | * | 2/2010 | Rieger et al. | 244/121 |

* cited by examiner

*Primary Examiner* — Bernarr Gregory
(74) *Attorney, Agent, or Firm* — Renner, Otto, Boisselle & Sklar, LLP

(57) ABSTRACT

A missile includes a separable shroud that covers a nose portion of the fuselage of the missile. The shroud covers and protects a seeker window and a seeker at the nose of the missile. The shroud is configured to remain coupled to the missile during and immediately after launch of the missile, and to separate during flight under the action of aerodynamic forces. Toward that end parts of the shroud are initially coupled together by a retainer, which allows the parts to separate during flight. The retainer may include one or more tension bands that break at a certain tension, and/or one or more weakened parts of the shroud, which break during flight. Parts of the shroud may include inward protrusions that make contact with an ogive portion of the nose of the fuselage.

18 Claims, 3 Drawing Sheets

MISSILE WITH SHROUD THAT SEPARATES IN FLIGHT

BACKGROUND OF THE INVENTION

1. Field of the Invention

The invention is in the field of missiles.

2. Description of the Related Art

There is a continuing need to protect powered missiles from damage before, during, and after launch.

SUMMARY OF THE INVENTION

According to an aspect of the invention, a detachable missile shroud includes two or more separable parts held together by a retainer.

According to another aspect of the invention, a detachable missile shroud is separated from the missile passively during missile flight, relying only on aerodynamic forces to separate the missile shroud from the missile.

According to yet another aspect of the invention, a method of operating a missile includes separating a shroud on the missile passively during flight of the missile.

According to still another aspect of the invention, a method of operating a missile includes separating a shroud on the missile during flight of the missile, using only aerodynamic forces.

According to a further aspect of the invention, a missile has a shroud on a nose portion, and canard covers between the shroud and a fuselage of the missile.

According to a still further aspect of the invention, a missile shroud has a front window that allows operation of a seeker through the window.

According to another aspect of the invention, a shrouded missile system includes: a powered missile that includes a nose portion; and a shroud that covers at least part of the nose portion. The shroud includes two or more shroud parts that are detachably coupled together by a retainer.

According to yet another aspect of the invention, a shrouded missile system includes: a powered missile that includes a nose portion; and a shroud that covers at least part of the nose portion. The shroud detaches from the missile during flight of the missile, due to action of aerodynamic forces on the shroud.

According to still another aspect of the invention, a method of operation of a missile includes the steps of: launching the missile with a shroud on a nose portion of the missile; and passively separating the shroud from the missile during flight of the missile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

A missile includes a separable shroud that covers a nose portion of the fuselage of the missile. The shroud covers and protects a seeker window and a laser or infrared (IR) seeker at the nose of the missile. The shroud is configured to remain coupled to the missile during and immediately after launch of the missile, and to separate during flight under the action of aerodynamic forces. Toward that end parts of the shroud are initially coupled together by a retainer, which allows the parts to separate during flight. The retainer may include one or more tension bands that break at a certain tension, and/or one or more weakened parts of the shroud, which break during flight. Parts of the shroud may include inward protrusions that make contact with an ogive portion of the nose of the fuselage. As aerodynamic drag forces press the shroud back onto the missile (toward the aft end of the missile), the shroud part inward protrusions are pressed further back along the ogive nose portion, in essence riding along the tapered or ogive nose surface to a wider part of the nose. This increases force radially outward on the shroud parts against the retainer. Eventually the outward force is sufficient to overcome the strength of the retainer, causing the shroud parts to separate from one another, and the shroud to separate from the missile fuselage. The shroud may include a disc plate or other structure that allows the seeker to function by receiving signals while the shroud is still in place. The missile may be launched from a launcher that includes multiple missiles, with one purpose of the shroud being to protect the seekers and other parts of unlaunched (unfired) missiles from debris in the exhaust streams (rocket plumes) of missiles being launched.

Figure 1:
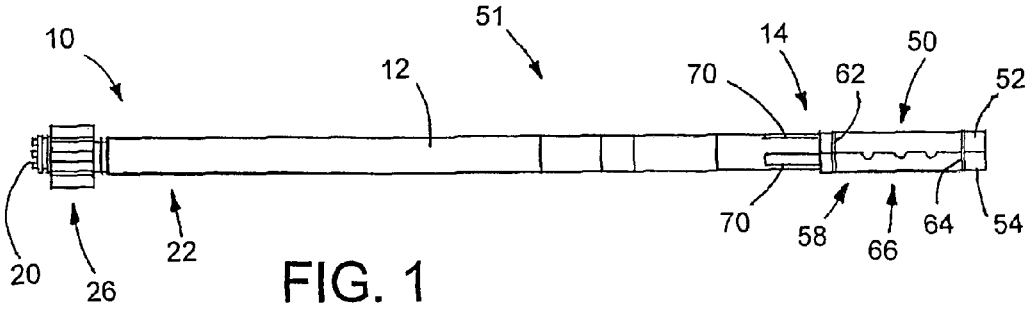
FIG. 1 is a side view of a missile in accordance with an embodiment of the present invention.
Figure 2:
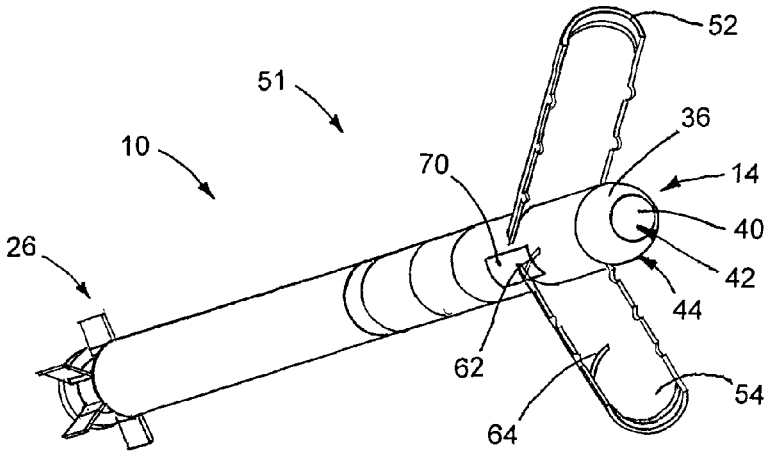
FIG. 2 is an oblique view of the missile of FIG. 1, with a shroud on the missile in the process of separating.
Figure 3:
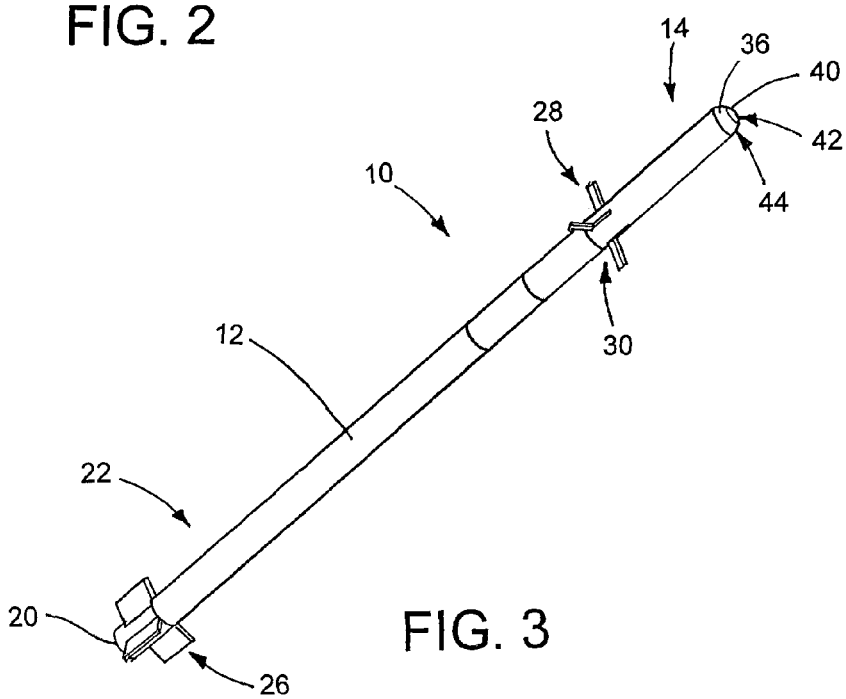
FIG. 3 is an oblique view of the missile of FIG. 1, with the shroud completely separated from the missile.

Referring initially to FIGS. 1-3, a missile 10 has a fuselage 12 with a nose portion 14. The missile 10 is a powered missile with a rocket engine 20 in an aft portion 22. It will be appreciated that alternatively the missile may be substituted by an unpowered projectile. The missile 10 has aft fins 26 that provide stability in flight, and forward canards 28 that may be used for steering the missile 10. The canards 28 deploy from slots 30 in the fuselage 12. It will be appreciated that other known configurations may be used to provide stability to the missile 10 and/or to steer the missile 10.

The nose portion 14 includes a seeker 36. The seeker 36 may be a laser or infrared (IR) seeker that is used to aid in steering the missile 10, for instance by acquiring information regarding the location of a target or other destination of the missile 10. The seeker 36 may be operatively coupled to the canards 28 or other steering mechanism of the missile 10, in order to direct the course of the missile 10. The seeker 36 may be any of a variety of well-known seekers used for gathering targeting information. Although laser and IR seekers are mentioned above, it will be appreciated that the seeker alternatively may be another type of seeker, such as an optical seeker.

The seeker 36 receives signals through a seeker window 40 at the front of the nose portion 14. The seeker window 40 may have a dome shape or other blunt-shaped outer surface 42, and may be made of a suitable material that allows signals of appropriate wavelength to be transmitted therethrough. For instance if the seeker 36 is a laser or IR seeker, then the window 40 may be made of material that allows suitable radiation to pass through it. Examples of suitable materials for the window 40 are sapphire, coated optical glass, and polyetherimide products sold under the trademark ULTEM.

The nose portion 14 also includes an ogive-shape nose surface 44 that forms the outer surface of the nose portion immediately aft of the seeker window 40. More broadly, the nose surface 44 may be considered a wedge shape or a tapered shape, which means that it increases in radial extent as one move longitudinally aftward from the window 40. The nose surface 44 and the seeker window outer surface 42 may together form a substantially continuous surface.

Figure 4:
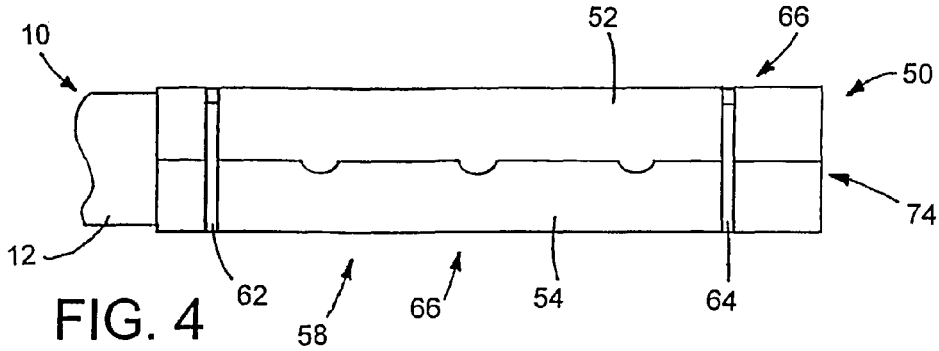
FIG. 4 is a side view of a nose portion of the missile of FIG. 1, showing details of the shroud of the missile.
Figure 5:
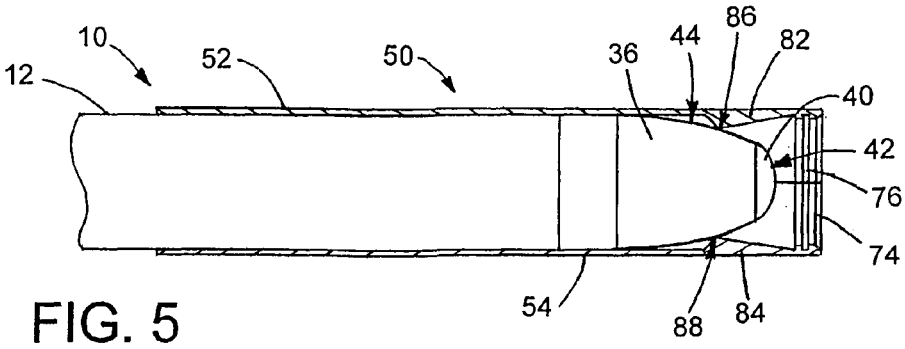
FIG. 5 is a side sectional view of the nose portion of FIG. 4.

With reference now in addition to FIGS. 4 and 5, a shroud 50 is used to protect the nose portion 14 from damage before, during, and for a time after launch of the missile 10. The missile 10 and a shroud 50 together constitute a missile system 51. The shroud 50 has generally cylindrical shape, surrounding and covering the outer surface of at least part of the nose portion 14. In particular the shroud 50 shields and protects the tapered or curved front surface of the nose portion 14 (consisting of the seeker window surface 42 and the nose surface 44). The shroud 50 may protect the seeker window 40 from possible damage from a variety of sources.

The shroud 50 is configured to remain on the missile 10 before and during launch. In addition the shroud 50 remains on the missile 10 during an initial portion of flight. The shroud 50 protects portions of the missile 10 from damage due to exhaust gasses and other debris expelled from a launching missile. As explained in greater detail below, the missile 10 may be one of a plurality of missiles launched from a single launcher, with the plurality of missiles in close proximity to one another. One or more of the missiles may be fired before the others, sending exhaust gases (a rocket plume) or other debris onto the other missiles still in the launcher. In addition the shroud 50 may protect the missile from other possible sources of damage, such as rain drops.

The shroud 50 has a pair of shroud halves 52 and 54 that are held together by a retainer 58, such as a pair of retainer bands 62 and 64. The bands 62 and 64 encircle the shroud halves, and are configured to break during flight of the missile 10. This allows the halves 52 and 54 to separate from each other, and from the missile 10. The bands 62 and 64 may be configured to break by a choice of material and dimensions, or by some sort weakening of material, such as scoring of the material of the bands 62 and 64. The bands 62 and 64 may be made of any of a variety of suitable materials, for example steel, aluminum, or plastic.

The shroud halves 52 and 54 may be half tubes, together making up a hollow cylinder 66 that fits over the nose portion 14. It will be appreciated that the cylinder 66 alternatively may be made up of more than two parts, for example three or more parts that fit together or are held together to form a cylinder that can separate from the missile 10 during flight.

The shroud 50 surrounds the nose portion 14 in the sense that the shroud 50 surrounds substantially all of a circumferential perimeter of the nose portion 14, for at least part of the axial (longitudinal) length of the nose portion 14. In addition the shroud 50 may include a cap at its front surface that covers substantially all of a front (longitudinally forward) surface of the nose portion 14.

The shroud 50 also may include canard covers 70 (FIGS. 1 and 2) that initially cover the canard slots 30. The canard covers 70 are held place against the fuselage 12 by the shroud halves 52 and 54. The canard covers 70 protect the canards 28 and canard seals from damage, prior to the firing of the missile 10. The canard covers 70 may be plastic pieces that are flat or are curved to correspond to the curvature of the fuselage. The canard covers 70 may fall away from the missile 10 as the shroud 50 separates from the missile 10, with the canard covers 70 falling away as separate pieces. Alternatively the canard covers 70 may be attached to the shroud parts 52 and 54.

The shroud 50 may also include a disc plate shroud window (cover) 74 that fits into a groove 76 that is at the front end of the shroud cylinder 66. The plate or cover 74 may be made of a material that allows transmission of signals to and from the seeker 36. The presence of the disc plate 74 allows protection of the seeker 36 and the seeker window 40, while still allowing some operation of the seeker 36 with the shroud 50 in place. While it is possible to make the disc plate 74 of the same material as the seeker window 40, it may be advantageous to use a lower-cost material for the disc plate 74, such as a suitable plastic. While a plastic disc plate window 74 may suffer some damage from exhaust gases or debris, it still may provide sufficient transmissibility of radiation of a suitable wavelength range so as to allow acceptable operation of the seeker 36.

The disc plate 74 may be secured in the groove 76, such as by use of a suitable adhesive. This keeps the disc plate 74 with one of the shroud halves 52 or 54 when the shroud 50 separates from the missile 10. Alternatively the disc plate 74 may be placed in the groove 76 without securing it to either of the shroud halves 52 and 54. In this configuration the disc plate 74 may be separated from the rest of the shroud 50 as the shroud 50 separates from the missile 10.

It will be appreciated that the disc plate 74 may have any of a variety of other suitable shapes and/or configurations. For example the plate 74 alternatively may have a non-flat shape, such a dome shape or curved shape. Although such shapes may have advantages in optical properties and/or aerodynamic properties, it will be appreciated that a flat plate 74 may have an advantage in being less expensive to produce.

Figure 6:
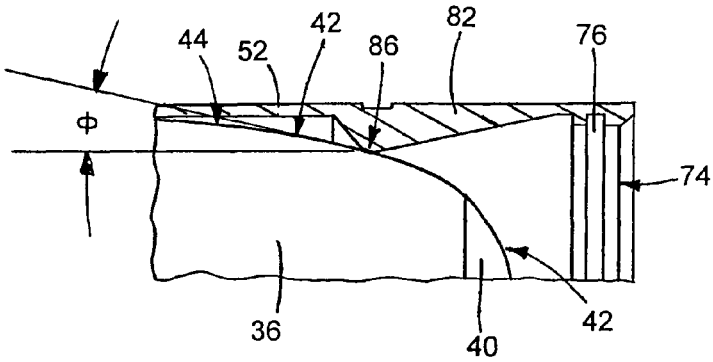
FIG. 6 is a magnified sectional view of part of the nose portion of FIG. 4.

FIG. 6 shows details of the interaction between the nose surface 44, and the shroud half 52. As can be seen from FIG. 5, the shroud half 54 interacts in a similar manner with the nose surface 44. The shroud halves 52 and 54 have respective inward protrusions 82 and 84 that make contact with the nose surface 44 at contact points 86 and 88. The inward protrusions 82 and 84 extend radially inward from the cylindrical outer shells of the shroud halves 52 and 54. The protrusions 82 and 84 may be integrally formed as parts that are continuous and monolithic with the rest of the halves 52 and 54. The halves 52 and 54 may be molded parts, for example, with the protrusions 82 and 84 being integrally formed as molded portions of the halves 52 and 54. For example the halves 52 and 54 may be made of a suitable high-performance plastic, which may be molded. Alternatively the protrusions 82 and 84 may be attached to the cylindrical parts of the halves 52 and 54 after initial formation of the cylindrical parts. For example the shroud halves 52 and 54 may be made of aluminum, with the outer cylindrical parts first being formed, such as by being extruded or otherwise suitably formed, and the protrusions 82 and 84 then attached to the inside surfaces of the cylindrical parts, such as by welding.

The protrusions 82 and 84 may have a triangular cross-section shape, although it will be appreciated that the protrusions may have other suitable shapes. It may be advantageous for the protrusions 82 and 84 to have point contacts 86 and 88 with the tapered nose surface 44. The protrusions 82 and 84 may extend around the entire perimeter of the nose surface 44, essentially making a circular line contact at a longitudinal location of the nose surface 44. Alternatively the protrusions 82 and 84 may make contact with only certain parts of a perimeter of the nose surface 44.

Under aerodynamic drag, the shroud 50 presses back against the nose portion 14. The nose surface 44 is tapered, presenting an angled surface at the contact points 86 and 88. As the protrusions 82 and 84 press against the nose surface 44, the nose surface 44 presses back against the protrusions 82 and 84. Portions of the reaction force press forward in an axial (longitudinal) direction and outward in the radial direction. The radially outward force causes the shroud halves 52 and 54 to press outward against the retainer 58, such as the retainer bands 62 and 64. As the missile moves faster, the shroud 50 presses harder back against the nose portion 14. This may move the shroud halves 52 and 54 longitudinally aft, with the shroud halves 52 and 54 riding along the nose surface 44 to a wider part of the nose portion 14. This increases the reaction force, and therefore also the radially outward component of the reaction force against the retainer bands 62 and 64. Eventually the reaction force is sufficient to overcome the resistance of the retainer 58, which fails (such as by breakage of the retainer bands 62 and 64) and allows the shroud halves 52 and 54 to separate from one another. This causes the shroud 50 to separate from the missile 10.

The release mechanism of the shroud 50 advantageously is a passive release mechanism, relying only on aerodynamic forces to release the shroud 50. This avoids the use of some sort of active mechanism for releasing the shroud 50. Active mechanisms, such as mechanical mechanisms or pyrotechnic devices, can fail to operate, leaving a shroud in place and perhaps resulting in loss of the missile. By contrast, the term "passive" is used herein to refer to release mechanisms that operate without any need for actuation. Passive release mechanisms operate incidentally to the flight process of the missile, not relying on a separate signal or actuation. The release of the retainer 58 is repeatable. Even if the retainer 58 fails to release (break) as expected, increasing aerodynamic forces will tend to release later in flight of the missile 10. In addition the release mechanism of the shroud 50 is simple and inexpensive, which are further advantages.

It will be appreciated that the resistance of the retainer 58 can be varied to control time and/or distance of flight before the shroud 50 separates from the missile 10. For example, if earlier separation of the shroud 50 is desired, the retainer bands 62 and 64 with reduced strength (lower force required for breakage) may be selected so as to allow the shroud 50 to separate with a lower outward push on the shroud halves 52 and 54. There may be many reasons for controlling the time and/or distance of shroud separation. For instance, different missiles may have different sensors that have different requirements, such as different foreign object damage (FOD) requirements or other different safety requirements. Different end users of the same type of missile may have different requirements, necessitating the need for different breaking force requirements.

Figure 7:
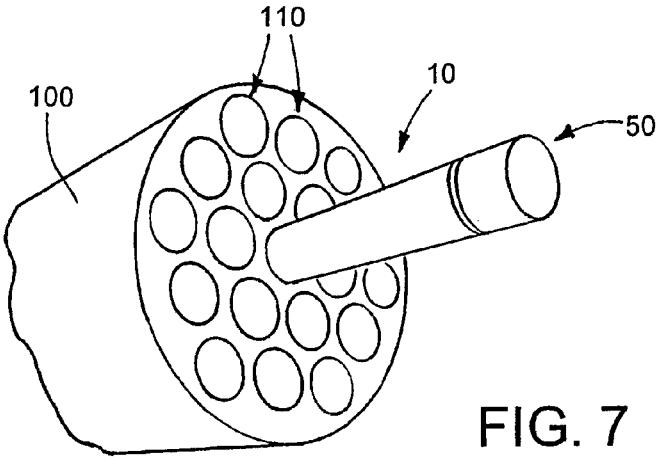
FIG. 7 is an oblique view of a missile launcher usable for launching the missile of FIG. 1.

FIG. 7 shows a missile launcher 100 for launching multiple missiles 10. The missile launcher 100 has multiple launch tubes 110, closely packed together, with each of the launch tubes 110 receiving one of the missiles 10. As discussed above, some of the missiles 10 may be fired from the launcher 100 before other of the missiles 10. The shrouds 50 on the later-fired missiles 10 may aid in preventing damage or degradation from exhaust gasses or other debris produced by earlier-fired missiles.

Figure 8:
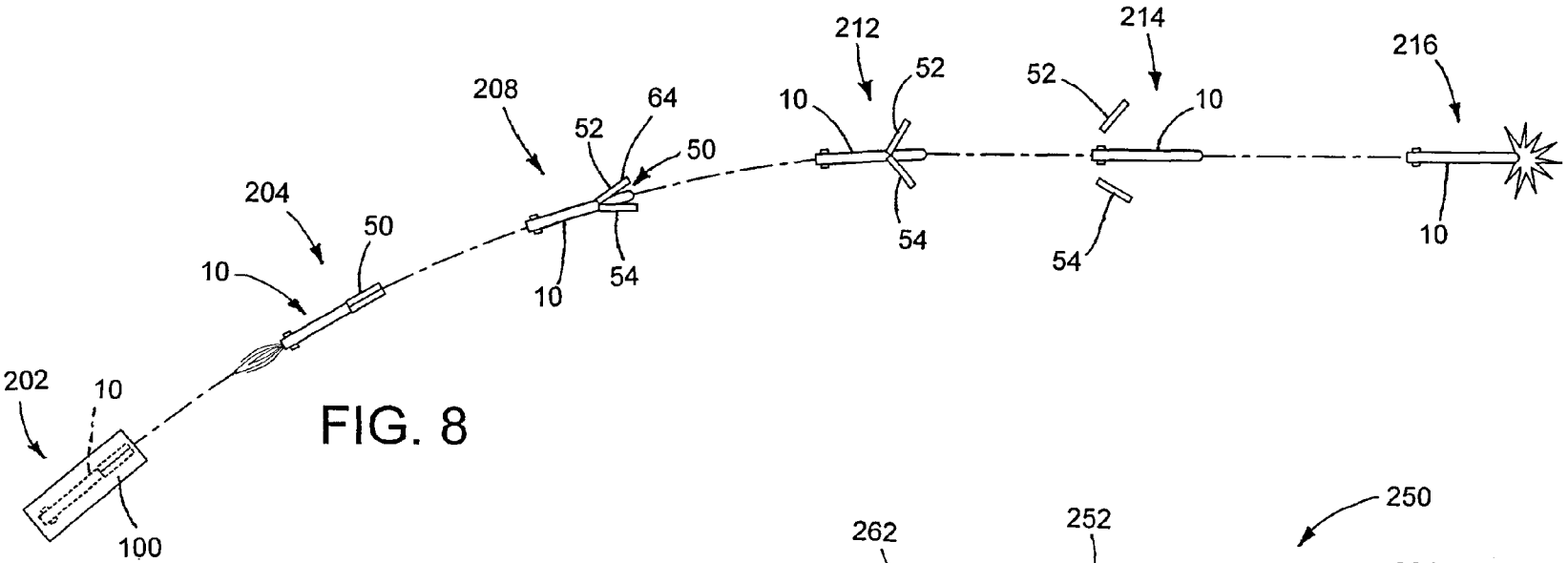
FIG. 8 is a schematic view showing steps in the process of the flight of the missile of FIG. 1.

FIG. 8 illustrates steps in launch and flight of the missile 10. The missile 10 begins in the launcher 100, as illustrated at 202. Reference number 204 shows the missile 10 having launched, with the shroud 50 retained in place on the missile 10. The shroud 50 begins separation as shown at reference number 208, with the retainer bands 62 and 64 breaking, and the shroud halves 52 and 54 opening up from each other. The opening of the shroud halves 52 and 54 allows aerodynamic forces on the shroud halves 52 and 54 to open them further, as shown at reference number 212. Then the shroud halves 52 and 54 separate entirely from the missile 10, as shown at 214, and the unshrouded missile 10 proceeds to its intended target, as shown at 216.

Figure 9:
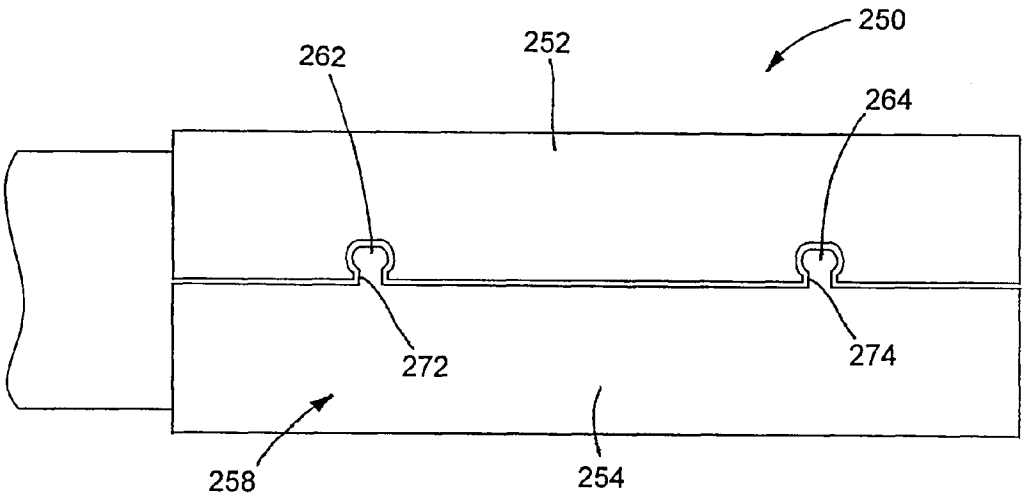
FIG. 9 side view of a portion of an alternate embodiment shroud usable with the missile of FIG. 1.

FIG. 9 illustrates an alternative shroud 250 in which a pair of shroud halves 252 and 254 are coupled together by a retainer 258, which includes integrally-formed breakaway members or components 262 and 264. The breakaway components 262 and 264 are configured to break when a sufficient radial force is applied from within the shroud halves 252 and 254. The breakaway components 262 and 264 have narrow necks 272 and 274 that may be configured to break when sufficient force is applied.

It will be appreciated that the illustrated embodiment is only one of many possible types of breakaway components that can be used in separating shroud parts when a sufficient force is applied. Other types of breakaway components include various sorts of thinned, scored, perforated, or other mechanically weakened portions of parts. Such breakaway components may be integral portions of the shroud halves or parts, or may be embodied in separate pieces. It will also be appreciated that breakaway members or components may be combined with retainer bands such as the retainer bands 62 and 64 (FIG. 4) described above.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A shrouded missile system comprising:

a self-powered missile that includes a nose portion; and a shroud that covers at least part of the nose portion;

wherein the shroud includes two or more shroud parts that are detachably coupled together by a retainer;

wherein the retainer includes one or more bands that encircle the shroud parts.

2. The missile system of claim 1, wherein the shroud parts are shroud halves that together form a cylinder that encircles the at least part of the nose portion.

3. The missile of claim 2, wherein the shroud parts have inward protrusions that make contact with a tapered nose surface of the nose portion.

4. A shrouded missile system comprising:

a self-powered missile that includes a nose portion; and a shroud that covers at least part of the nose portion;

wherein the shroud includes two or more shroud parts that are detachably coupled together by a retainer;

wherein the shroud parts are shroud halves that together form a cylinder that encircles the at least part of the nose portion;

wherein the shroud includes a cover; and wherein the cover is forward of the nose portion.

5. The missile system of claim 4, wherein the cover is in a groove in the shroud halves.

6. The missile system of claim 5, wherein the cover is adhesively joined to one of the shroud halves.

7. The missile system of claim 4, wherein the cover is a flat plate.

8. The missile of claim 4, wherein the retainer includes one or more bands that encircle the shroud parts.

9. The missile of claim 4, wherein the shroud parts have inward protrusions that make contact with a tapered nose surface of the nose portion.

10. A shrouded missile system comprising:

a self-powered missile that includes a nose portion; and a shroud that covers at least part of the nose portion;

wherein the shroud includes two or more shroud parts that are detachably coupled together by a retainer;

wherein the nose portion includes a seeker; and wherein the cover is a transmissive shroud window that allows signals to reach the seeker through the shroud window.

11. The missile system of claim 10, wherein the nose portion also includes a seeker window that is protected by the shroud window.

12. A shrouded missile system comprising:

a self-powered missile that includes a nose portion; and a shroud that covers at least part of the nose portion;

wherein the shroud includes two or more shroud parts that are detachably coupled together by a retainer; and wherein the shroud parts have inward protrusions that make contact with a tapered nose surface of the nose portion.

13. The missile system of claim 12, wherein the tapered nose surface is an ogive-shaped nose surface.

14. The missile system of claim 12, wherein the shroud parts are shroud halves that together form a cylinder that encircles the at least part of the nose portion.

15. A shrouded missile system comprising:

a self-powered missile that includes a nose portion; and a shroud that covers at least part of the nose portion;

wherein the shroud includes two or more shroud parts that are detachably coupled together by a retainer; and wherein the shroud includes canard covers between the shroud parts and a fuselage of the missile.

16. The missile system of claim 4, wherein the retainer includes a breakaway part that breaks in order to allow the shroud parts to separate from one another.

17. A method of operation of a missile, the method comprising:

launching the missile with a shroud on a nose portion of the missile; and separating the shroud from the missile during flight of the missile using aerodynamic forces on the shroud, without actuation to cause the separating;

wherein the separating includes the aerodynamic forces pressing shroud halves of the shroud against a tapered nose surface of the nose portion;

wherein the nose portion includes a seeker and a seeker window;

wherein the shroud includes a shroud window coupled to the shroud halves; and further comprising the seeker receiving radiation through the shroud window during the flight of the missile.

18. The method of claim 17, wherein the separating includes the shroud halves pressing radially outward to break a retainer that prevents separation of the shroud halves.

* * * * *